US010365058B1

(12) United States Patent
Miller

(10) Patent No.: US 10,365,058 B1
(45) Date of Patent: Jul. 30, 2019

(54) MAGAZINE RELEASE

(71) Applicant: Nathan Miller, Blair, NE (US)

(72) Inventor: Nathan Miller, Blair, NE (US)

( * ) Notice: Subject to any disclaimer, the term of this patent is extended or adjusted under 35 U.S.C. 154(b) by 0 days.

(21) Appl. No.: 15/913,299

(22) Filed: Mar. 6, 2018

Related U.S. Application Data

(60) Provisional application No. 62/467,717, filed on Mar. 6, 2017.

(51) Int. Cl.
*F41A 17/38* (2006.01)

(52) U.S. Cl.
CPC ..... *F41A 17/38* (2013.01)

(58) Field of Classification Search
CPC ..... F41A 17/38; F41A 3/66; F41C 3/00
USPC ..... 42/6, 70.02, 7; 89/33.02, 33.01, 33.1
See application file for complete search history.

(56) References Cited

U.S. PATENT DOCUMENTS 4,449,311 A * 5/1984 Giragosian ..... F41A 35/06 42/7
4,521,985 A * 6/1985 Smith ..... F41A 35/06 42/7
4,539,770 A * 9/1985 Bornancini ..... F41A 35/06 42/7
4,713,902 A * 12/1987 Wigton ..... F41A 35/06 42/7
4,759,144 A * 7/1988 Egan ..... F41A 17/38 42/7
4,768,301 A * 9/1988 Thomas ..... F41A 17/38 42/7
4,835,892 A * 6/1989 Ruger ..... F41A 35/06 42/7
6,141,895 A * 11/2000 Rost ..... F41A 17/38 42/6
9,417,020 B2 * 8/2016 McGinty ..... F41A 35/06
9,541,340 B2 * 1/2017 Fluhr ..... F41A 17/38
9,964,372 B1 * 5/2018 O'Clair ..... F41A 9/59
2009/0031605 A1 * 2/2009 Robinson ..... F41A 15/12 42/2

* cited by examiner

*Primary Examiner* — John Cooper
(74) *Attorney, Agent, or Firm* — Suiter Swantz pc llo

(57) ABSTRACT

A magazine release assembly includes a first component. The first component includes at least one interlocking protrusion of an interlocking assembly and a button with a sloped surface. The first component is insertable into a first opening within a receiver frame of a handgun. The magazine release assembly includes an additional component. The additional component includes at least one interlocking recess of the interlocking assembly and a catch spring slot. The additional component is insertable into an additional opening with the receiver frame of the handgun. The at least one interlocking recess is configured to rotatably couple with the at least one interlocking protrusion within the receiver frame. The catch spring slot is configured to receive a catch spring following the rotatable coupling of the at least one interlocking recess and the at least one interlocking protrusion.

20 Claims, 15 Drawing Sheets

MAGAZINE RELEASE

CROSS-REFERENCE TO RELATED APPLICATIONS

The present application claims the benefit under 35 U.S.C. § 119(e) of U.S. Provisional Patent Application Ser. No. 62/467,717, filed Mar. 6, 2017, entitled MAGAZINE RELEASE, naming Nathan Miller as inventor, which is incorporated herein by reference in the entirety.

TECHNICAL FIELD

The present invention generally relates to the field of handguns and, in particular, to a magazine release for handguns.

BACKGROUND

Handguns have a magazine release that are operated via a user's thumb or middle finger. On select handguns, the magazine release has been reduced to a slim-profile version with a user-contact surface nearly flush with a surface of the handgun receiver. These magazine releases are difficult to use, requiring a direction or magnitude of force and/or contact by the user that is either counter-intuitive and/or unnecessarily restrictive. In addition, a user may have to move their hand and/or rotate the handgun to actuate the slim-profile magazine release, which may cause the user to relinquish some amount of control over the direction in which the handgun is pointed.

As such, it would be desirable to provide an apparatus that addresses the shortcomings of the previous approaches listed above.

SUMMARY

A system is disclosed, in accordance with one or more embodiments of the present disclosure. In one embodiment, the system includes a magazine release assembly. In another embodiment, the magazine release assembly includes a first component. In another embodiment, the first component includes at least one interlocking protrusion of an interlocking assembly and a button with a sloped surface. In another embodiment, the magazine release assembly includes an additional component. The additional component includes at least one interlocking recess of the interlocking assembly and a catch spring slot. In another embodiment, the system includes a handgun. The handgun includes a receiver frame. The receiver frame includes a first magazine release opening configured to receive the first component of the magazine release assembly. The receiver frame includes an additional magazine release opening configured to receive the additional component of the magazine release assembly. The receiver frame includes a catch spring retaining slot configured to hold a catch spring. In another embodiment, the at least one interlocking recess is configured to rotatably couple with the at least one interlocking protrusion within the receiver frame. In another embodiment, the catch spring slot is configured to receive the catch spring following the rotatable coupling of the at least one interlocking recess and the at least one interlocking protrusion.

A magazine release assembly is disclosed, in accordance with one or more embodiments of the present disclosure. In one embodiment, the magazine release assembly includes a first component. In another embodiment, the first component includes at least one interlocking protrusion of an interlocking assembly and a button with a sloped surface. In another embodiment, the first component is insertable into a first opening within a receiver frame of a handgun. In another embodiment, the magazine release assembly includes an additional component. In another embodiment, the additional component includes at least one interlocking recess of the interlocking assembly and a catch spring slot. In another embodiment, the additional component is insertable into an additional opening with the receiver frame of the handgun. In another embodiment, the at least one interlocking recess is configured to rotatably couple with the at least one interlocking protrusion within the receiver frame. In another embodiment, the catch spring slot is configured to receive a catch spring following the rotatable coupling of the at least one interlocking recess and the at least one interlocking protrusion.

A method is disclosed, in accordance with one embodiments of the present disclosure. In one embodiment, the method may include, but not limited to, inserting a first component of a magazine release assembly into a first opening within a receiver frame of a handgun. In another embodiment, the first component includes at least one interlocking protrusion of an interlocking assembly and a button with a sloped surface. In another embodiment, the method may include, but not limited to, inserting an additional component of the magazine release assembly into an additional opening within the receiver frame of the handgun. In another embodiment, the additional component includes at least one interlocking recess of the interlocking assembly and a catch spring slot. In another embodiment, the method may include, but not limited to, rotatably coupling the at least one interlocking recess with the at least one interlocking protrusion within the receiver frame. In another embodiment, the method may include, but not limited to, coupling a catch spring within the receiver frame of the handgun to the catch spring slot.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

FIGS. 1A-4G generally illustrate a magazine release for a handgun, in accordance with one or more embodiments of the present disclosure. It is noted herein that "magazine release" and "magazine release assembly" may be considered equivalent for purposes of the present disclosure.

Embodiments of the present disclosure are directed to a magazine release for a handgun. Embodiments of the present disclosure are also directed to a button of the magazine release configured to reduce an amount of force and/or direction of motion necessary to actuate the magazine release. Embodiments of the present disclosure are also directed to maintaining or lessening the potential for accidental release of the magazine by reducing the size and/or profile of a magazine release button while retaining intended functionality. Embodiments of the present disclosure are also directed to a method of installing and rotatably coupling components of the magazine release together within the handgun.

Figure 1A:
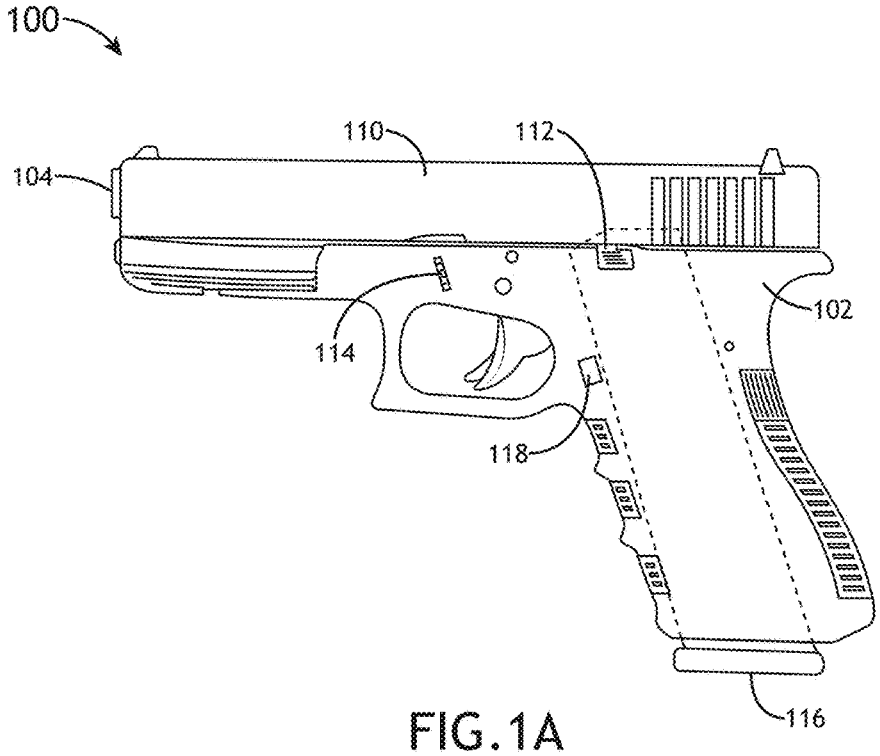
FIG. 1A illustrates a handgun including a magazine release, in accordance with one or more embodiments of the present disclosure.
Figure 1B:
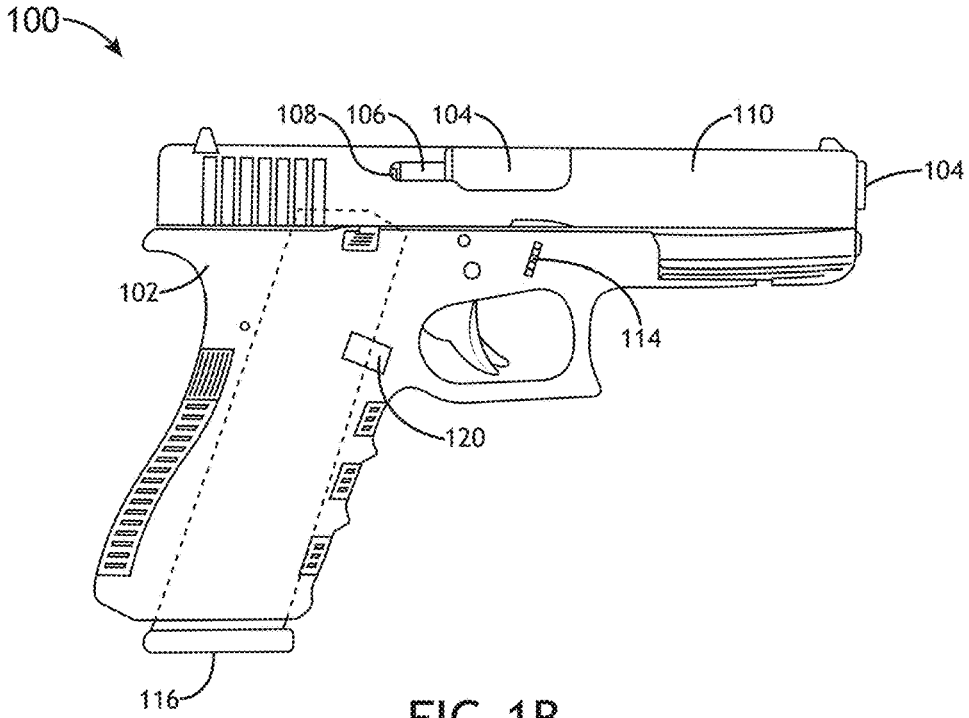
FIG. 1B illustrates a handgun including a magazine release, in accordance with one or more embodiments of the present disclosure.
Figure 2A:
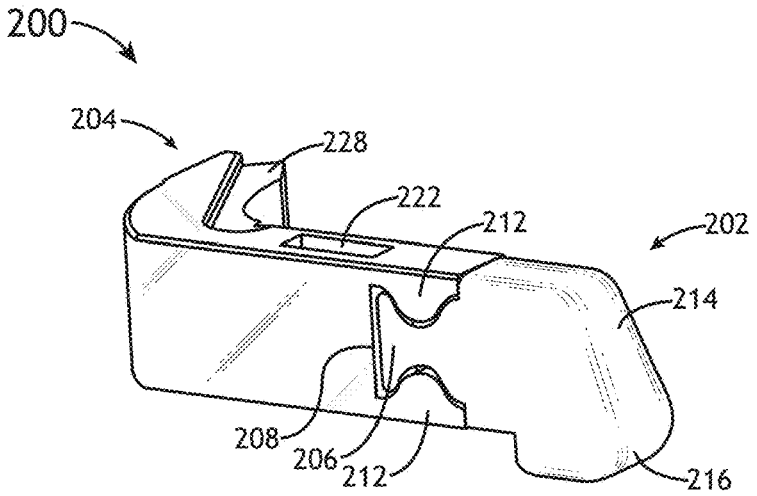
FIG. 2A illustrates a front isometric view of a magazine release, in accordance with one or more embodiments of the present disclosure.
Figure 2B:
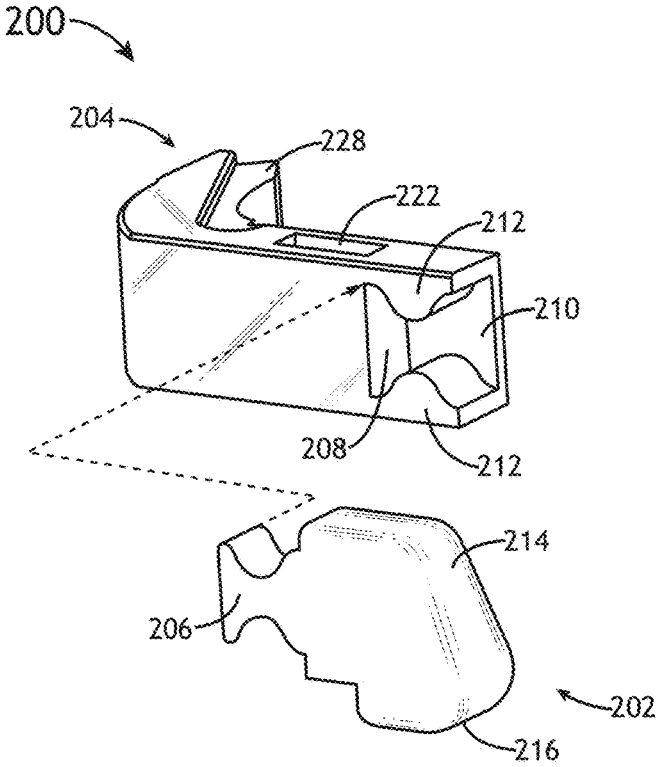
FIG. 2B illustrates an exploded front isometric view of a magazine release, in accordance with one or more embodiments of the present disclosure.
Figure 2C:
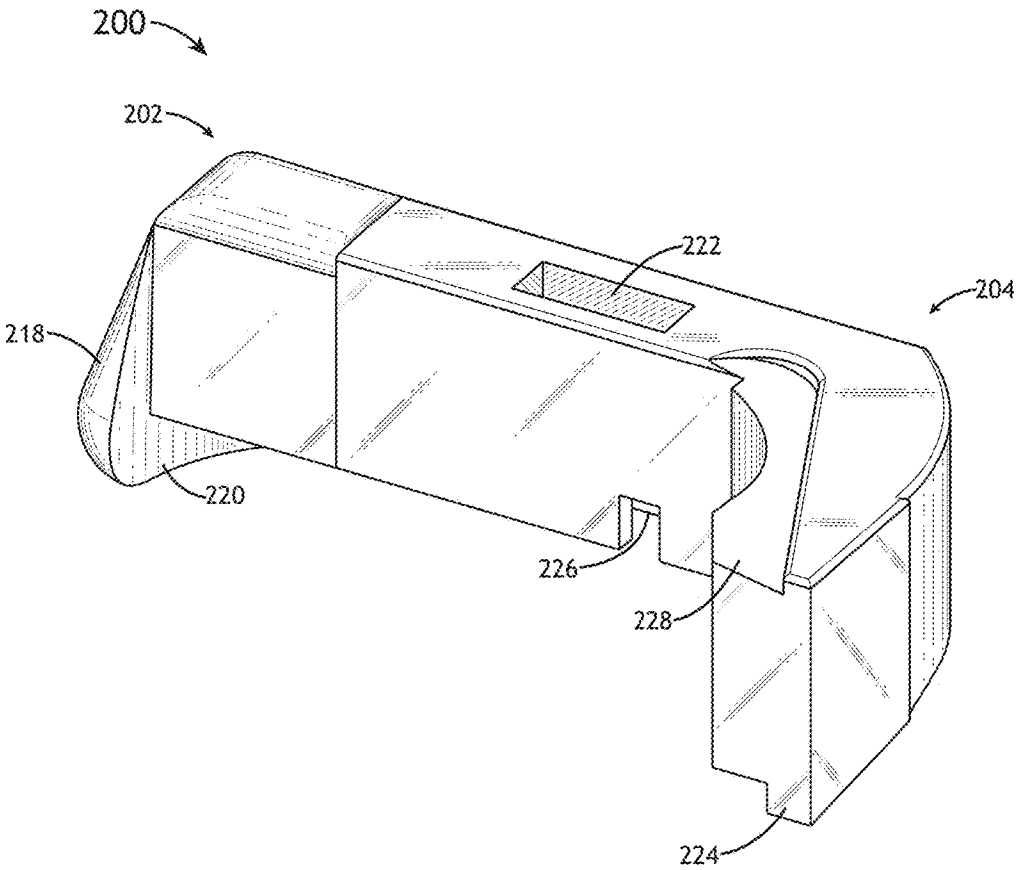
FIG. 2C illustrates a rear isometric view of a magazine release, in accordance with one or more embodiments of the present disclosure.
Figure 2D:
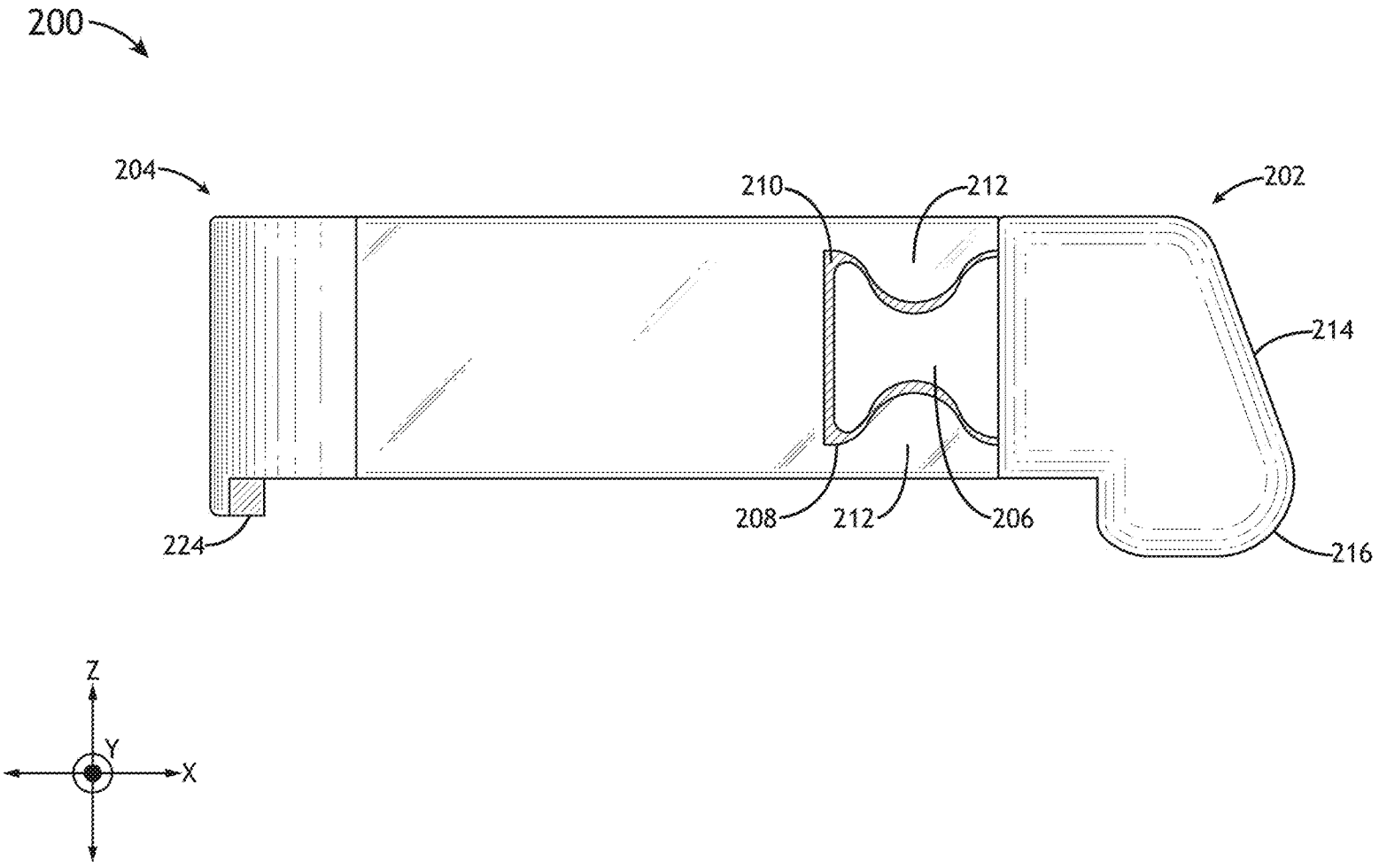
FIG. 2D illustrates a front view of a magazine release, in accordance with one or more embodiments of the present disclosure.
Figure 2E:
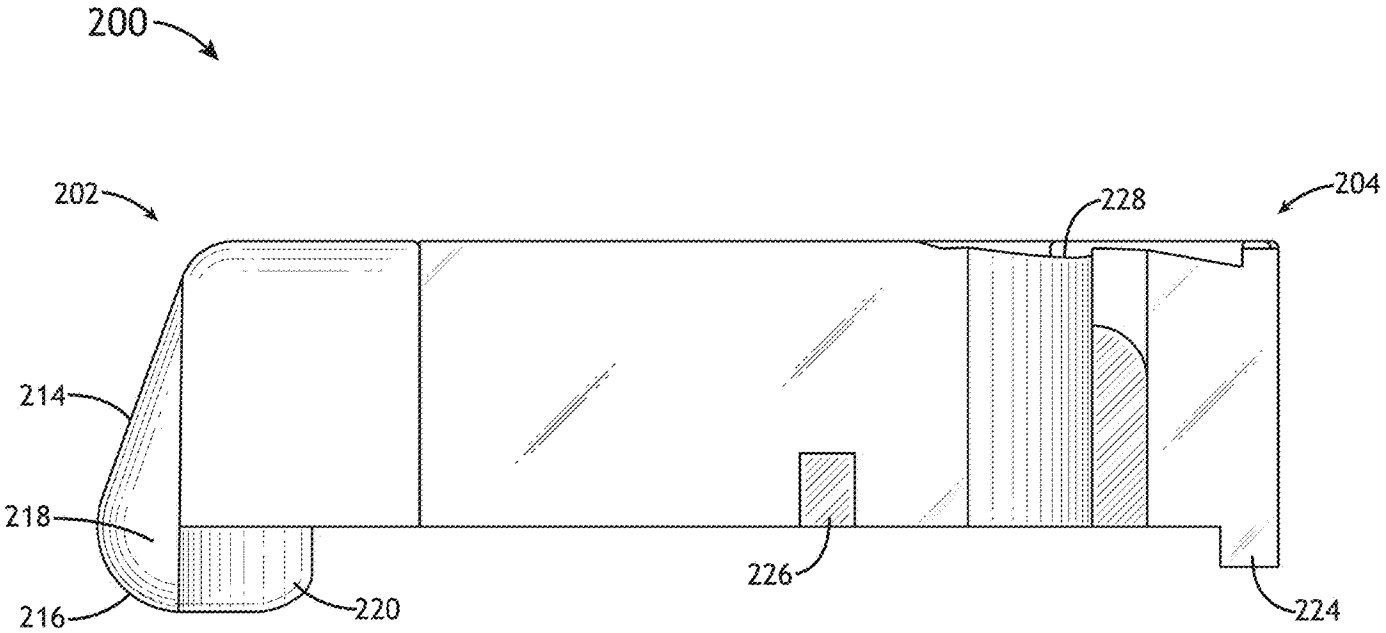
FIG. 2E illustrates a rear view of a magazine release, in accordance with one or more embodiments of the present disclosure.
Figure 2F:
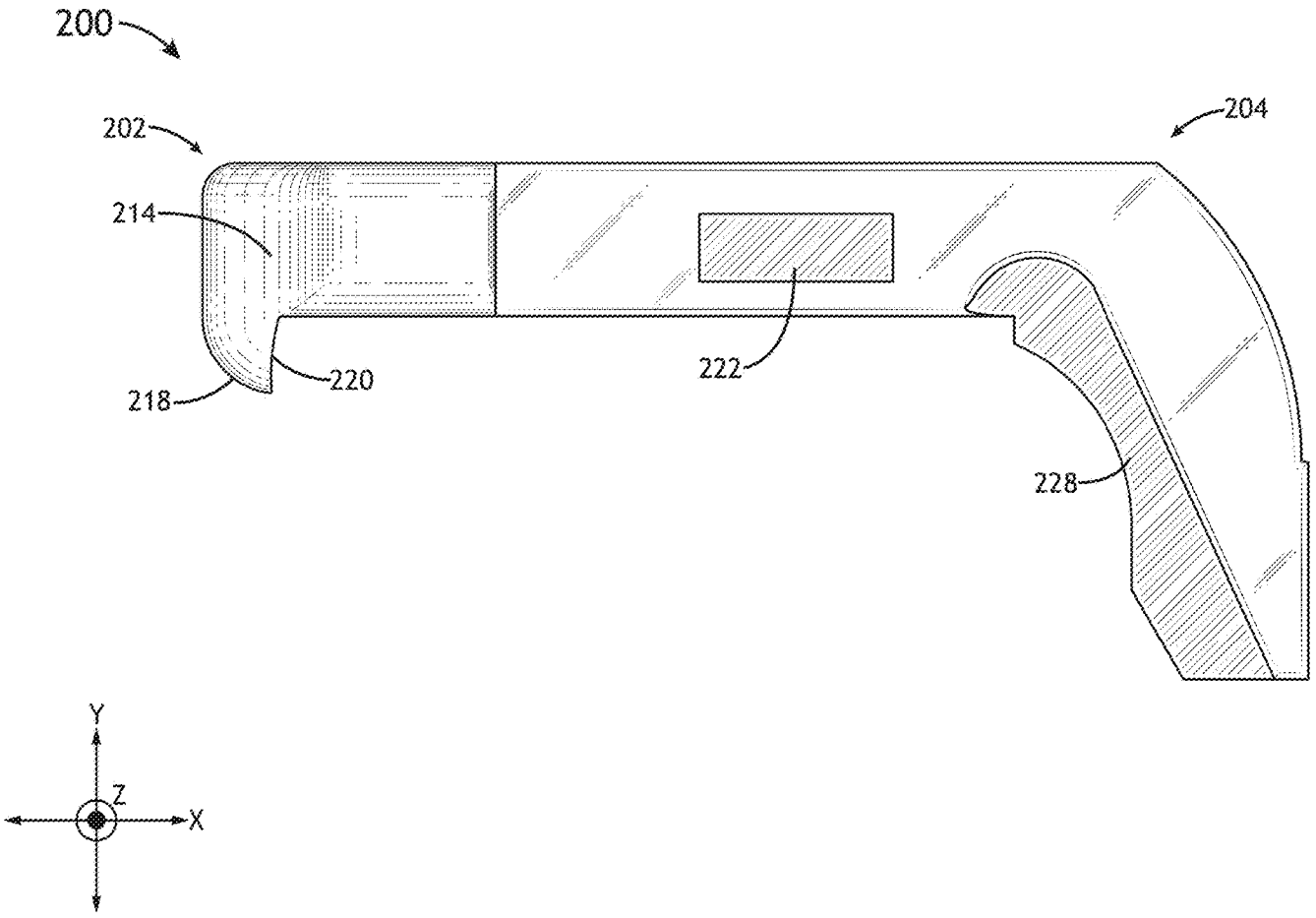
FIG. 2F illustrates a top view of a magazine release, in accordance with one or more embodiments of the present disclosure.
Figure 2G:
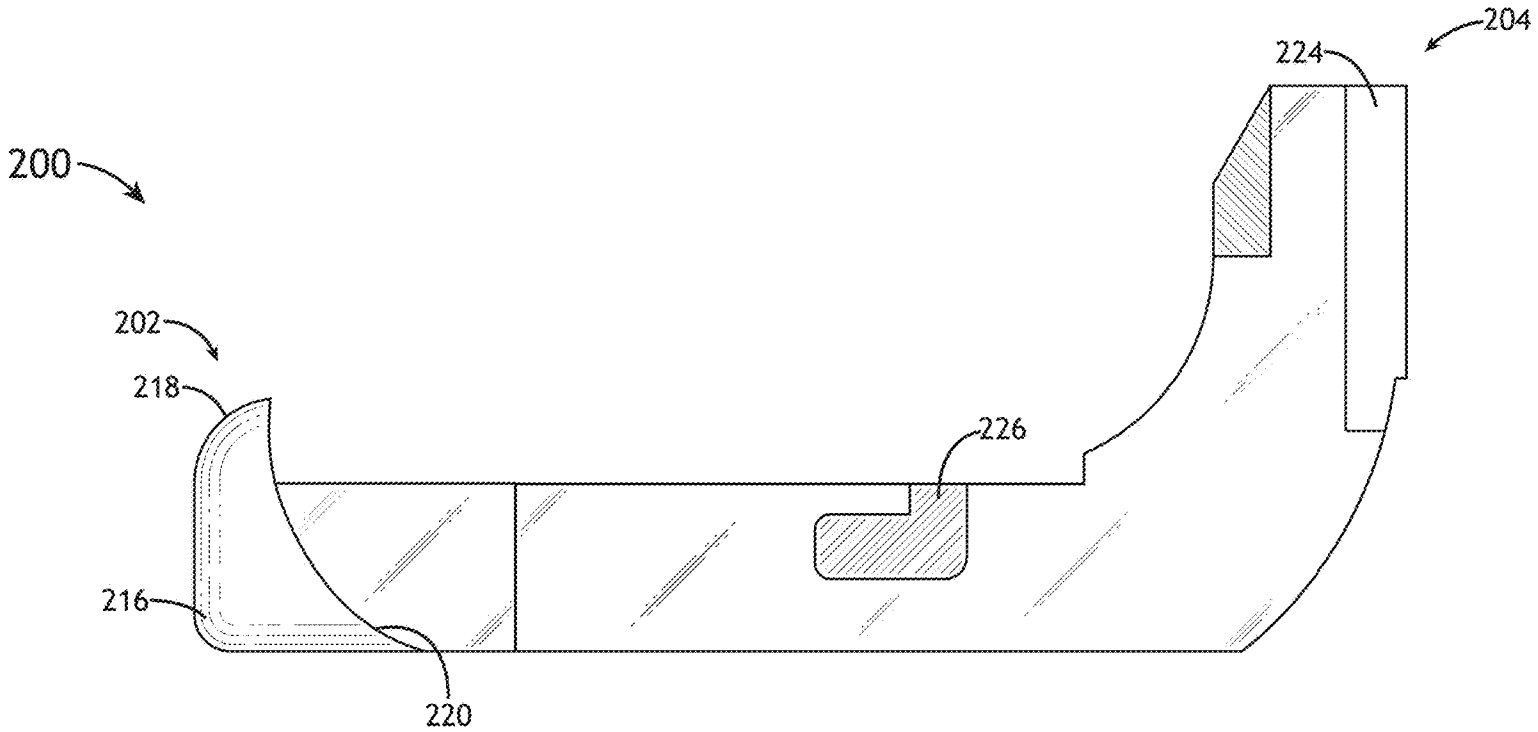
FIG. 2G illustrates a bottom view of a magazine release, in accordance with one or more embodiments of the present disclosure.
Figure 2H:
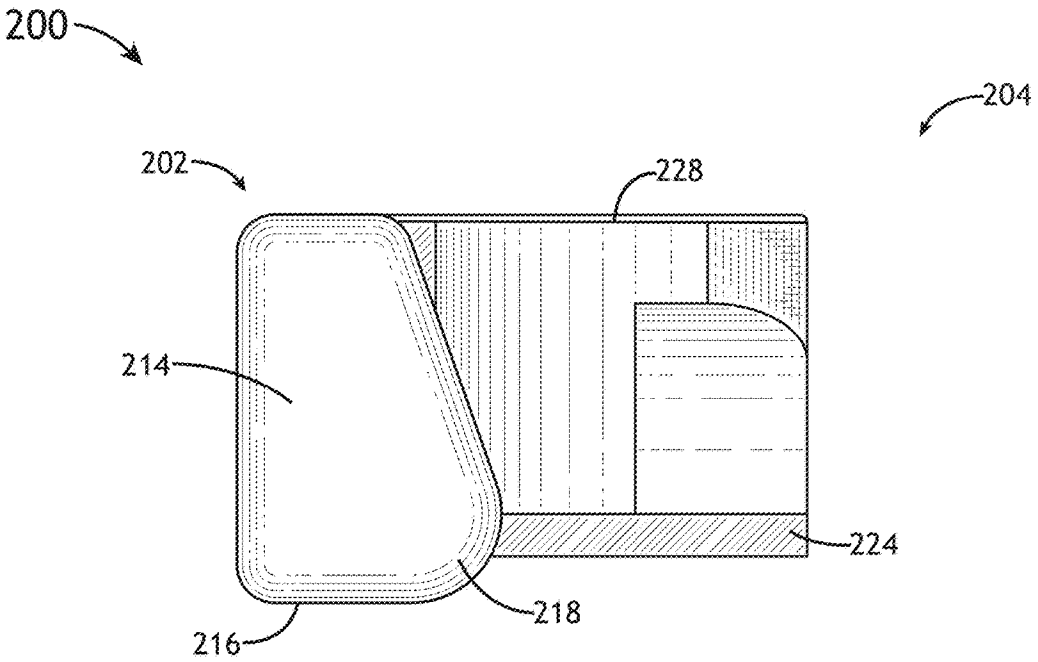
FIG. 2H illustrates a left view of a magazine release, in accordance with one or more embodiments of the present disclosure.
Figure 2I:
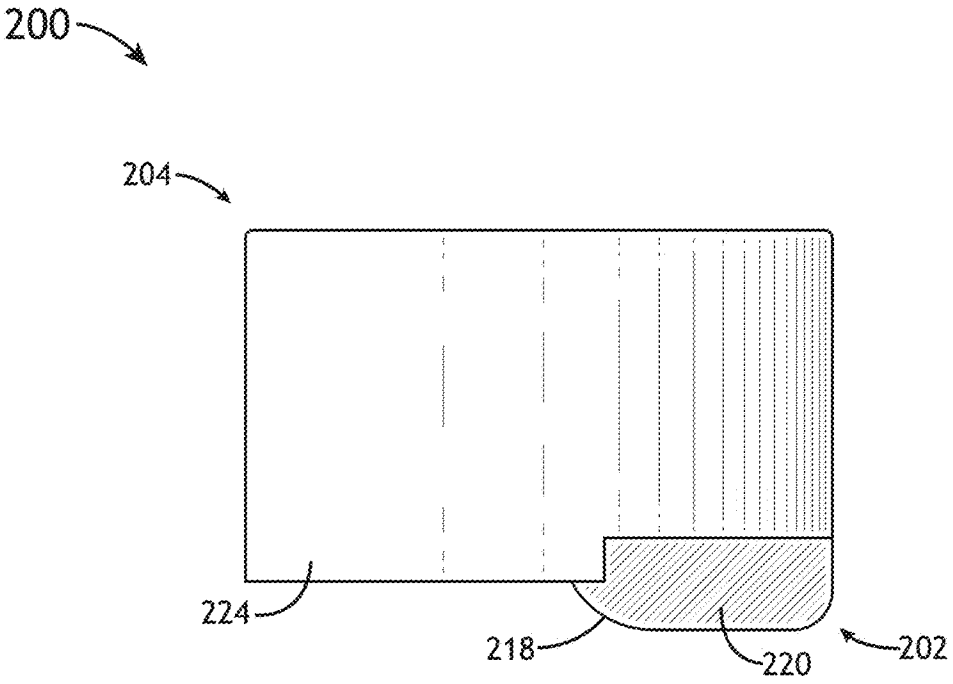
FIG. 2I illustrates a right view of a magazine release, in accordance with one or more embodiments of the present disclosure.

FIGS. 1A and 1B generally illustrate a handgun 100, in accordance with one or more embodiments of the present disclosure.

In one embodiment, the handgun 100 includes a receiver frame 102. In another embodiment, the handgun 100 includes a barrel 104. In another embodiment, the handgun 100 includes an extractor 106 and an extractor depressor plunger 108. For example, the extractor 106 and the extractor depressor plunger 108 may remove a casing (or entire cartridge) from the barrel 104.

In another embodiment, the handgun 100 includes a slide 110. For example, the casing removed from the barrel 104 by the extractor 106 may be ejected from the slide 110 via an ejector. In another embodiment, the handgun 100 includes a slide stop lever 112 configured to allow the slide 110 to engage a slide lock 114. In another embodiment, the handgun 100 includes a trigger.

In another embodiment, the receiver frame 102 includes an opening for a magazine 116 through a bottom surface of the receiver frame 102. In another embodiment, the receiver frame 102 includes an opening 118 through a left surface of the receiver frame 102. In another embodiment, the receiver frame 102 includes an opening 120 through a right surface of the receiver frame 102.

FIGS. 2A-2I generally illustrate a magazine release 200, in accordance with one or more embodiments of the present disclosure.

In one embodiment, the magazine release 200 includes one or more components. For example, the magazine release 200 may include a first component 202 (or left component, relative to the receiver frame 102) and an additional component 204 (or right component, relative to the receiver frame 102). In another embodiment the first component 202 and the additional component 204 are substantially the same thickness, such that the magazine release 200 includes a set of substantially flat surfaces along a majority of the length of the magazine release 200.

In another embodiment, the first component 202 and the additional component 204 are configured to couple via one or more interlocking assemblies. In another embodiment, an interlocking assembly includes one or more protrusions 206 (e.g., male connector) and one or more recesses 208 (e.g., female connector). For example, a protrusion 206 may be an extension coupled to the first component 202, and a recess 208 may be a depression in the additional component 204. In another embodiment, a recess 208 is configured to receive and mate with a protrusion 206. For example, the recess 208 may be configured to rotatably couple to the protrusion 206.

In another embodiment, the recess 208 includes a limiting surface 210. For example, the limiting surface 210 is set a selected depth into a component of the magazine release (e.g., the additional component 204). In another embodiment, the protrusion 206 contacts the limiting surface 210 after being inserted into the recess 208. For example, the limiting surface 210 may provide a stop point for the protrusion 206 when coupled to the recess 208. It is noted herein that the limiting surface 210 may provide reinforcement of the interlocking assembly against moment and/or tension forces.

Although embodiments of the present disclosure are directed to the recess 208 including the limiting surface 210, it is noted herein that the recess may be a cut-out or hole within a component of the magazine release 200, such that a corresponding protrusion 206 may pass through the recess 208. Therefore, the above description should not be interpreted as a limitation on the present disclosure, but merely an illustration.

In another embodiment, the interlocking assembly includes a dovetail-based interlocking assembly. For example, the recess 208 may include one or more dovetail protrusions 212 that conform to one or more dovetail recesses in the protrusion 206. For instance, the protrusion 206 may resist moment and/or tension forces, where tension forces may cause the protrusions 212 to expand and further engage the recess 208. It is noted herein the dovetail-based interlocking assembly may prevent tear-apart of the magazine release 200 should either the first component 202 or the additional component 204 get caught when removing the handgun 100 from a holster.

Generally, the interlocking assembly may include any locking configuration known in the art including, but not limited to a dovetail, a peg of a select shape and a corresponding hole or recess, or any other design that may be rotatably coupled together. Therefore, the above description should not be interpreted as a limitation on the present disclosure but merely an illustration.

Although embodiments of the present disclosure are directed to the first component 202 including the protrusion 206 and the additional component 204 including the recess 208, it is noted herein that the first component 202 may include the recess 208 and the additional component 204 may include the protrusion 206. In addition, it is noted herein that the first component 202 and the additional component 204 may each include a portion of an interlocking protrusion and recess assembly. Therefore, the above description should not be interpreted as a limitation on the present disclosure but merely an illustration.

In another embodiment, the first component 202 includes a button. In another embodiment, the button is configured to maintaining or lessening the potential for accidental release of the magazine through reduction of the size and/or profile while retaining intended functionality. In another embodiment, the button includes a sloped surface 214. For example, the sloped surface 214 may be based on an angle relative to an axis (e.g., z-axis) through the receiver frame 102. By way of another example, the sloped surface 214 may be based on an angle ranging from ten to thirty-five degrees. For instance, the sloped surface 214 may be based on an angle of twenty degrees.

In another embodiment, the button includes an extension surface 216. For example, the extension surface 216 may be curved or rounded. It is noted herein that, where the first component 202 is inserted into an opening of the receiver frame 102, the button may be larger than the opening such that the extension surface 216 may extend below the opening (e.g., the opening 118) within the receiver frame 102.

In another embodiment, the button includes a flare protrusion surface 218. For example, the flare protrusion surface 218 may include a sloped surface based on an angle relative to an axis (e.g., y axis) of the receiver frame 102. By way of another example, the flare protrusion surface 218 may be based on an angle ranging from five to sixty degrees. For instance, the flare protrusion surface 218 may be based on an angle of fifteen degrees. In another embodiment, the button includes a contour profile surface 220. For example, the contour profile surface 220 may substantially map or conform to the profile of a side (e.g., left side) of the receiver frame 102 when the button is fully depressed.

Generally, it is noted herein that the button and its various surfaces 214, 216, 218 provide a user with increased or improved means to actuate the magazine release 200. Select handguns known in the art include magazine releases that have a button that has a slim-line profile corresponding with the surface of the receiver frame 102. The slim-line profile requires direct force to be applied through the central axis of the magazine release with a tip of a finger, which may not have the full strength of the hand when gripping a handgun and/or may be injured through continued actuation.

In contrast, the button and its various surfaces 214, 216, 218 may be configured to alter the amount of force and/or direction of motion necessary to actuate the magazine release 200. For example, the sloped surface 214 may provide a contact point for a user's thumb or finger (e.g., middle finger). For instance, the sloped surface 214 may provide a surface area for a user to utilize when actuating the magazine release 200 via a downstroke of the thumb, changing the direction of motion when applying force down or perpendicular to a central axis through the magazine release 200. In this regard, forces caused by a catch spring pin within the receiver frame 102 of the handgun 100, which causes a depressed magazine release 200 to return to rest from a depressed position, do not affect the actuation of the magazine release 200. Also, in this regard a different set of muscle groups in the hand may be utilized when actuating the magazine release 200.

By way of another example, the extension surface 216 may provide a contact point for a user's thumb or finger (e.g., middle finger). For instance, the extension surface 216 may provide a surface area for a user to utilize when actuating the magazine release 200 via a push with a middle finger. For example, the flare protrusion surface 218 may provide a contact point for a user's thumb or finger (e.g., middle finger) during actuation of the magazine release 200. For instance, the flare protrusion surface 218 may provide an increased reachability and/or increased surface area for a user to utilize when actuating the magazine release 200 via a downstroke of the thumb. Therefore, the above description should not be interpreted as a limitation on the present disclosure but merely an illustration.

In another embodiment, the button includes a pry tool slot 222. For example, the pry tool slot 222 may be rectangular, circular, elliptic, and/or hexagonal. Generally, the pry tool slot 222 may be any shape known in the art. In another embodiment, the pry tool slot 222 provides a point for a user to interact with (e.g., provide a force to) when uncoupling the first component 202 (e.g., the protrusion 206) and the additional component 204 (e.g., the recess 208). By way of another example, the pry tool slot 222 is configured to receive a pry tool. For instance, the pry tool may include, but is not limited to, a flat screwdriver blade, a small-diameter round metal rod, and/or a knife tip. Generally, the pry tool may include any tool configured to fit within the pry tool slot 222.

In another embodiment, the additional component 204 includes a limit protrusion 224. For example, the limit protrusion 224 may interact (e.g., couple to, make contact with, or the like) with a portion of the receiver frame 102. For instance, the portion of the receiver frame 102 may include, but is not limited to, a limit cut in the right side of the receiver frame 102 below the opening 120. It is noted herein that interacting with the portion of the receiver frame 102 may prevent the magazine release 200 from entering the receiver frame 102 when returning to a rest (or un-depressed) position.

In another embodiment, the additional component 204 includes a catch spring slot 226. For example, a catch spring may be inserted into the catch spring slot 226 following installation of the magazine release 200 within the receiver frame 102. In this regard, a force may be exerted on the magazine release 200 by the catch spring via the catch spring slot 226 that causes a depressed magazine release 200 to return to a rest position.

In another embodiment, the additional component 204 includes a magazine catch 228. For example, the magazine catch 228 may interact with (e.g., couple to, make contact with, or the like) a tab molded to the magazine 116. By way of another example, the magazine catch 228 may provide a retaining force to the magazine 116, thus keeping the magazine 116 to stay seated within the receiver frame 102 until the magazine release 200 is depressed.

In another embodiment, the additional component 204 includes a logo or product indicator. For example, the logo or product indicator is a fabricated portion of the additional component 204. By way of another example, the logo or product indicator is adhered to the additional component 204 (e.g., a sticker). By way of another example, the logo or product indicator is painted on the additional component 204.

The magazine release 200 may be dimensioned to couple to one or more components of a first-generation, second-generation, or third-generation Glock handgun (e.g., the receiver frame 102 may include, but is not limited to, a first-generation, second-generation, or third-generation Glock polymer receiver frame). Generally, the magazine release 200 may be coupled to one or more components of any handgun 100 known in the art capable of receiving the magazine release 200. Therefore, the above description should not be interpreted as a limitation on the present disclosure but merely an illustration.

It is noted herein the dimensions of the one or more components of the magazine release 200 may change based on a particular fabrication method and tolerances associated with the particular fabrication method. For example, the particular fabrication method may produce a finished and/or fully-processed part. By way of another example, the particular fabrication method may produce a part requiring post-fabrication finish processing. In addition, corners and/or edges may be rounded or clean depending on the particular fabrication method. Therefore, the above description should not be interpreted as a limitation on the present disclosure but merely an illustration.

Figure 3:
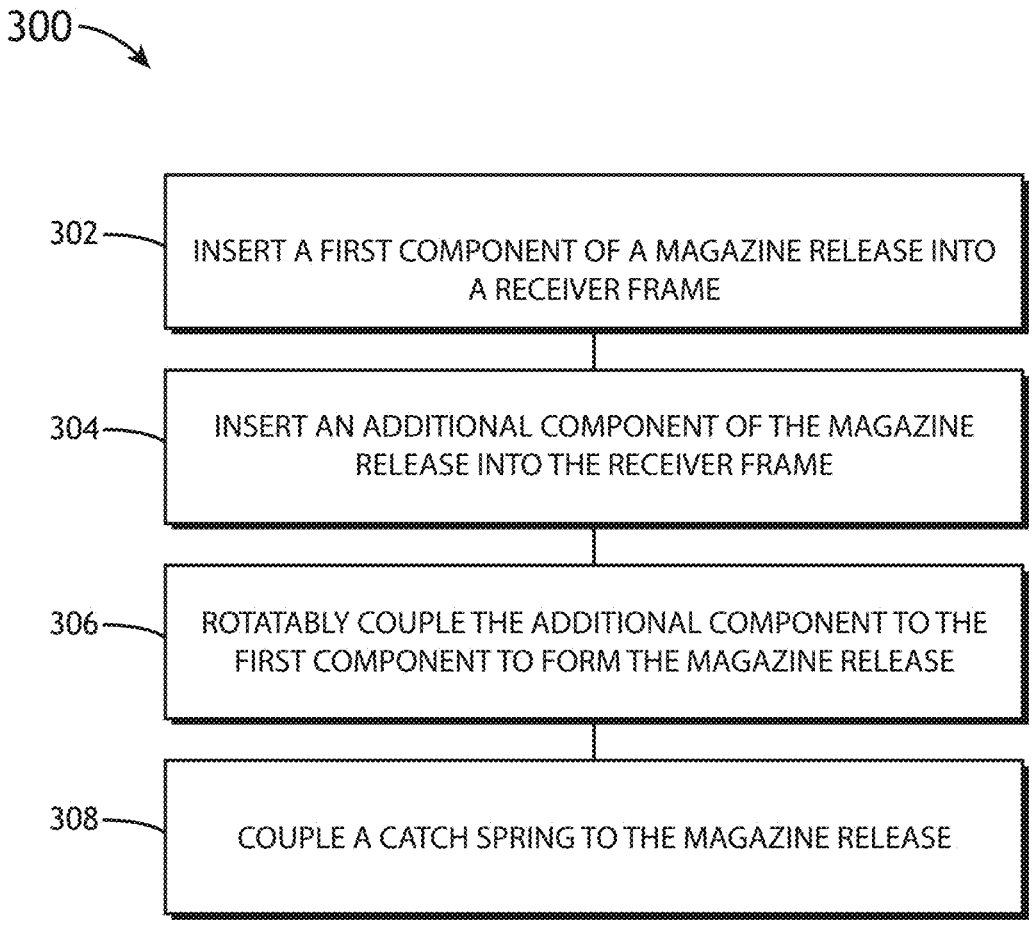
FIG. 3 illustrates a process flow diagram of a method for forming a magazine release within a receiver of a handgun, in accordance with one or more embodiments of the present disclosure.

FIG. 3 illustrates a method 300 for coupling together the first component 202 and the additional component 204 of the magazine release 200, in accordance with one or more embodiments of the present disclosure. It is noted herein the method 300 is not limited to the steps provided. For example, the method 300 may instead include more or fewer steps. By way of another example, the method 300 may perform the steps in an order other than provided. Therefore, the above description should not be interpreted as a limitation on the scope of the present disclosure, but merely an illustration.

It is noted herein that method 300, as depicted in FIG. 3, may be more readily understood with reference to FIGS. 4A-4G. FIGS. 4A-4G generally illustrate the coupling together of the first component 202 and the additional component 204 of the magazine release 200 within the receiver frame 102 of the handgun 100, in accordance with one or more embodiments of the present disclosure.

Figure 4A:
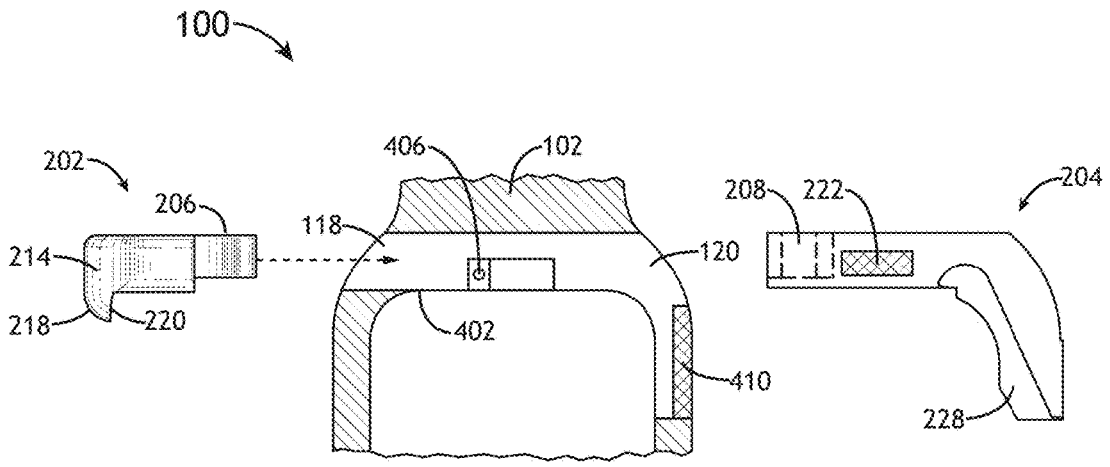
FIG. 4A illustrates a top section view of a receiver of a handgun including components of a magazine release, in accordance with one or more embodiments of the present disclosure.

In step 302, a first component of a magazine release is inserted into a receiver frame of a handgun. In one embodiment, as illustrated in FIG. 4A, the first component 202 is inserted into the opening 118 of the receiver frame 102 of the handgun 100. In another embodiment, the first component 202 is inserted into its fully depressed position, such that a break or separation point of the first component 202 is even with or beyond a frame edge 402.

Figure 4B:
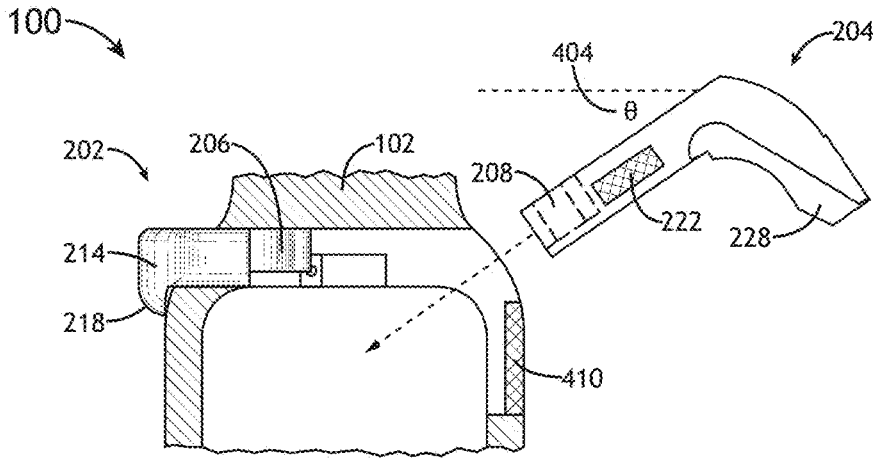
FIG. 4B illustrates a top section view of a receiver of a handgun including components of a magazine release, in accordance with one or more embodiments of the present disclosure.
Figure 4C:
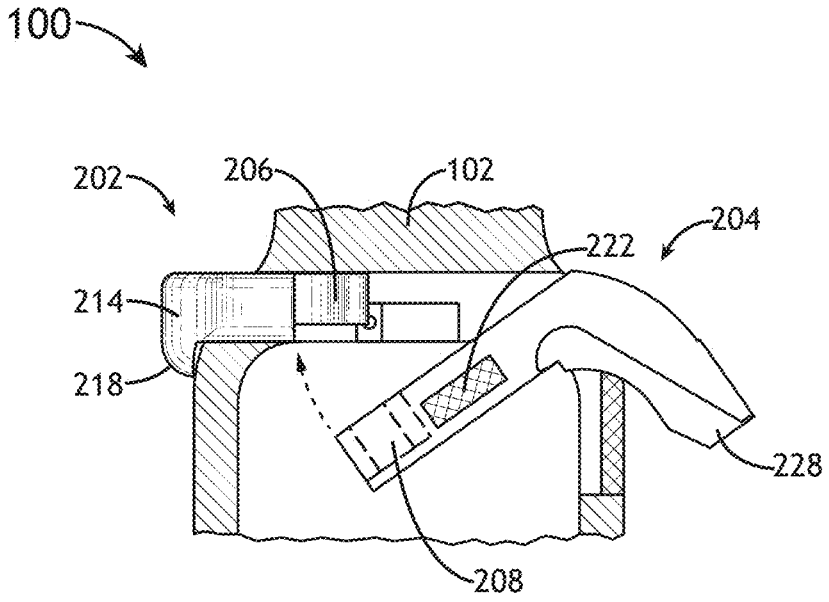
FIG. 4C illustrates a top section view of a receiver of a handgun including components of a magazine release, in accordance with one or more embodiments of the present disclosure.
Figure 4D:
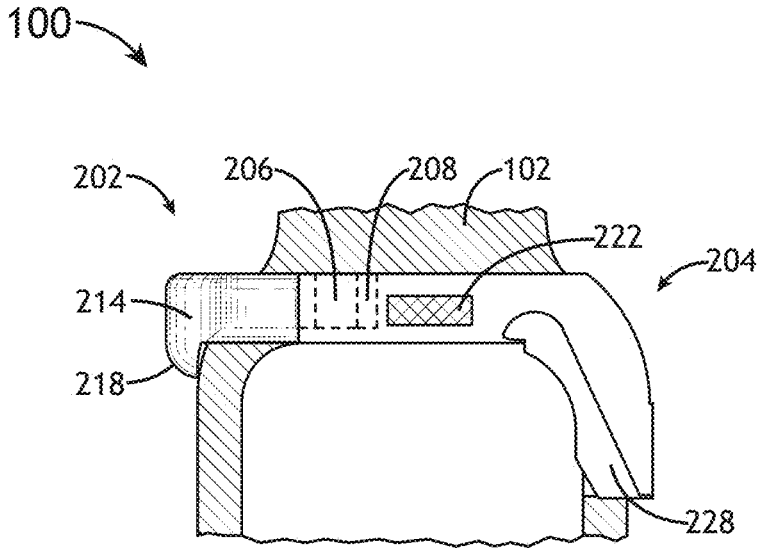
FIG. 4D illustrates a top section view of a receiver of a handgun including a magazine release in a depressed position, in accordance with one or more embodiments of the present disclosure.
Figure 4E:
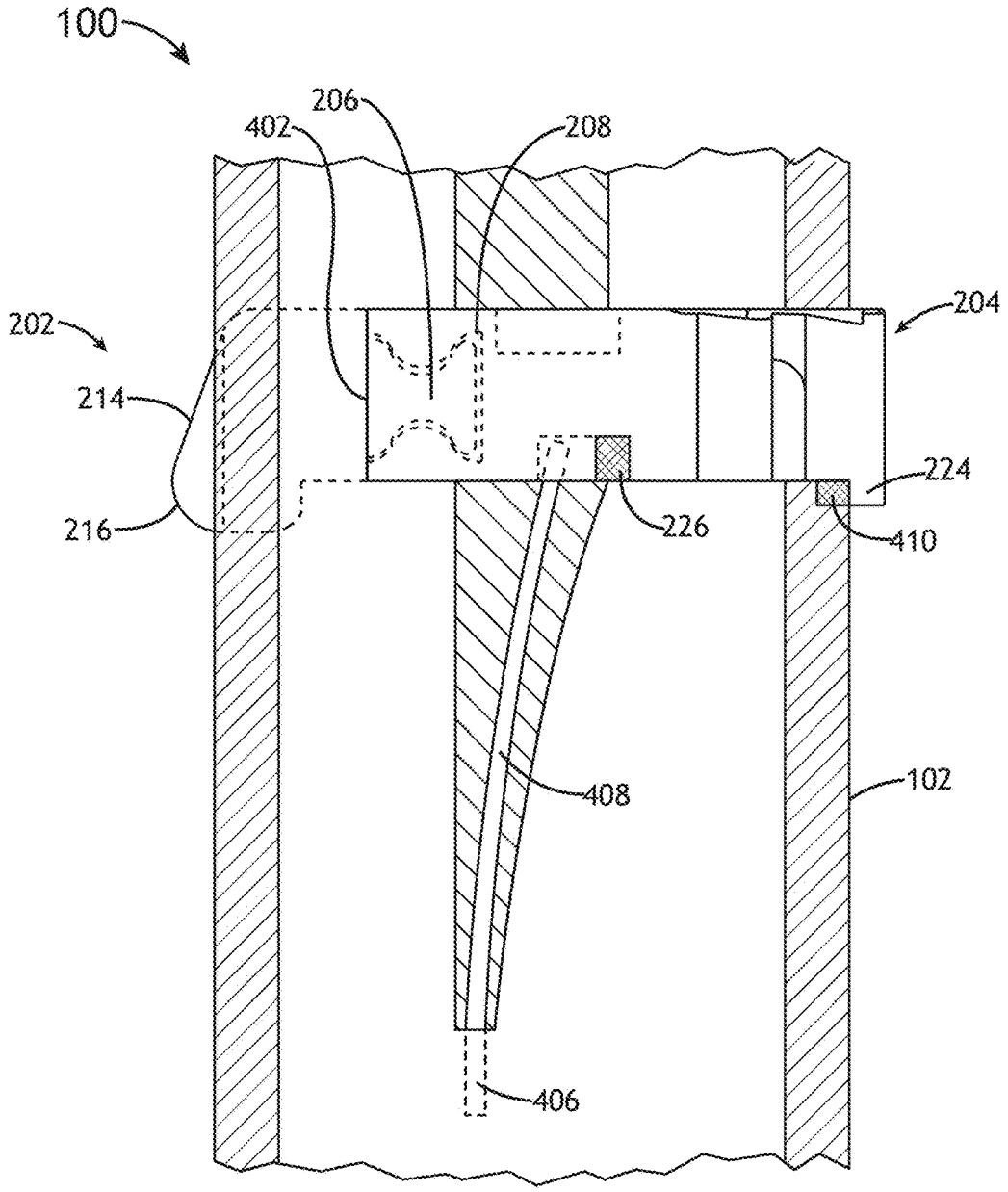
FIG. 4E illustrates a rear section view of a receiver of a handgun including a magazine release in a depressed position, in accordance with one or more embodiments of the present disclosure.

In another embodiment, as illustrated in FIG. 4E, the interlocking assembly is integrated into the magazine release 200 such that the frame edge 402 is in line with the break or separation point between the first component 202 and the additional component 204 when the magazine release 200 is depressed. In this regard, the first component 202 and the additional component 204 may be coupled together without interference by the receiver frame 102. It is noted herein that FIG. 4D illustrates a top view of a depressed magazine release 200, while FIG. 4E illustrates a rear view of the depressed magazine release 200.

Figure 4F:
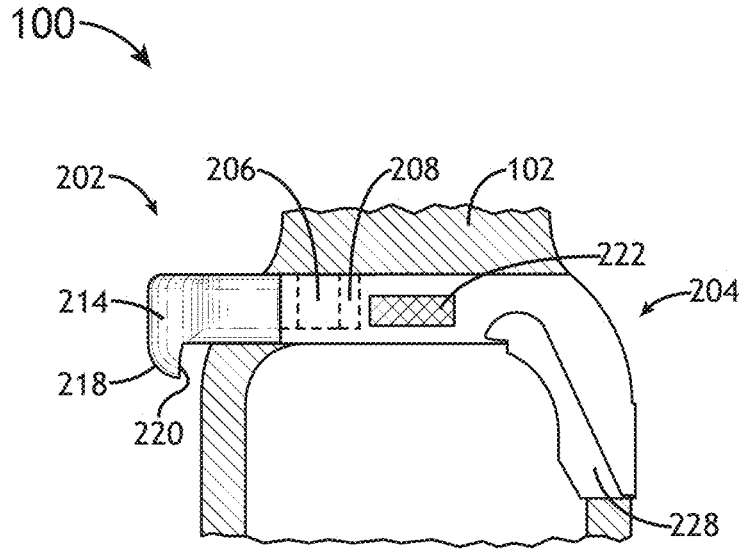
FIG. 4F illustrates a top section view of a receiver of a handgun including a magazine release in a rest position, in accordance with one or more embodiments of the present disclosure.
Figure 4G:
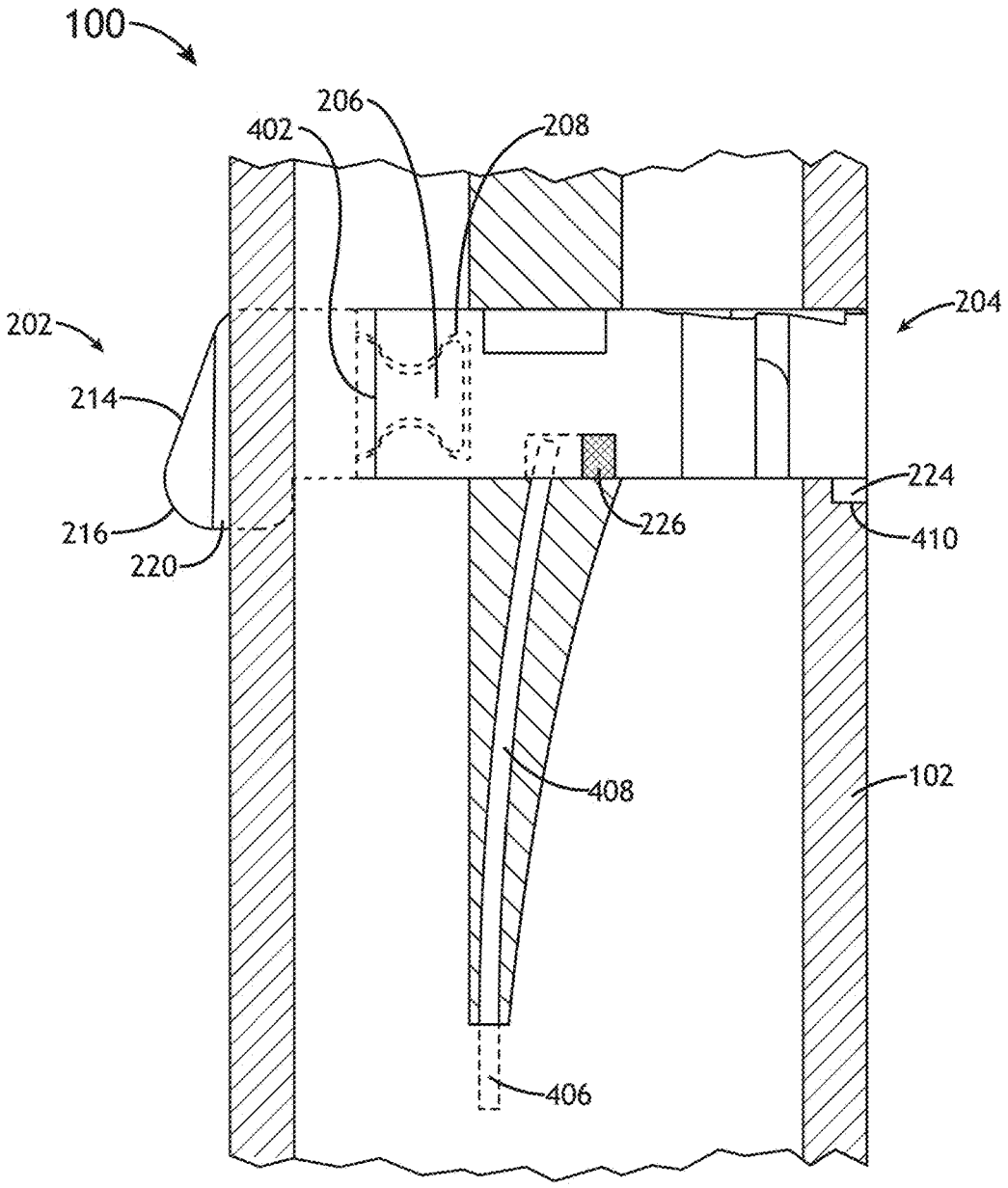
FIG. 4G illustrates a rear section view of a receiver of a handgun including a magazine release in a rest position, in accordance with one or more embodiments of the present disclosure.

In another embodiment, as illustrated in FIG. 4G, the interlocking assembly is integrated into the magazine release 200 such that the frame edge 402 covers at least a portion of the break or separation point between the first component 202 and the additional component 204 when the magazine release 200 is in a rest position. In this regard, the frame edge 402 restrains the magazine release 200 and prevents the first component 202 and the additional component 204 from uncoupling when in the rest position. It is noted herein that FIG. 4F illustrates a top view of a magazine release 200 in a rest position, while FIG. 4G illustrates a rear view of the magazine release 200 in the rest position.

Although the frame edge 402 may not provide retention support when the magazine release 200 is depressed, it is noted herein that retention support is provided by the catch spring 408 and/or the magazine 116 when the magazine release 200 is depressed. Therefore, the above description should not be interpreted as a limitation on the scope of the present disclosure but merely an illustration.

In step 304, an additional component of the magazine release is inserted into the receiver frame of the handgun. In one embodiment, as illustrated in FIG. 4B, the additional component 204 is inserted into the opening 120 of the receiver frame 102 at an angle 404. For example, the angle 404 may range from twenty to forty degrees. For instance, the angle 404 may be thirty degrees. In another embodiment, the additional component 204 is inserted into the opening 120 to a depth that the additional component 204 may be coupled to the first component 202.

In step 306, the additional component is rotatably coupled to the first component to form the magazine release. In one embodiment, as illustrated in FIG. 4C, the additional component 204 is rotated around at least one axis within the opening 120 until it couples to the first component 202. For example, the recess 208 may be aligned to receive the protrusion 206 of the first component 202 via a rotational motion about a first axis. By way of another example, the recess 208 may encompass the protrusion 206 of the first component 202 via a rotation motion about the first axis or an additional axis. In another embodiment, the recess 208 encompasses the protrusion 206 until a selected depth is reached, the selected depth defined by the depth of the limiting surface 210 within the recess 208. In another embodiment, expansion of the interlocking assembly is limited by a channel of the receiver frame 102 in which the magazine release 200 is inserted, the channel accessible via at least the opening 118 of the receiver frame 102.

In step 308, a catch spring is coupled to the magazine release. In one embodiment, as illustrated in FIGS. 4A, 4E, and 4G, the receiver frame 102 includes a catch spring retainer 406. In another embodiment, the catch spring retainer 406 is configured to receive a catch spring 408. For example, the catch spring 408 may include, but is not limited to, a rounded, spring steel pin. In another embodiment, the catch spring 408 is coupled to the catch spring slot 226 on the additional component 204 of the magazine release 200. For example, the catch spring 408 may be coupled to the catch spring slot 226 when the magazine release 200 is either in any position (e.g., a depressed position, a rest position, or the like). By way of another example, the catch spring 408 may be manipulated with a guider tool (e.g., screwdriver) or pry tool to couple to the catch spring slot 226 after the catch spring 408 is installed within the catch spring retainer 406. In this regard, the catch spring 408 may provide a tension force to return the magazine release 200 to a rest position after the magazine release 200 has been depressed by a user.

In one embodiment, the receiver frame 102 includes a limit cut 410 in the receiver frame 102. For example, the limit cut 410 may interact (e.g., couple to, make contact with, or the like) with the limit protrusion 224. For instance, interacting with the portion of the limit cut 410 may prevent the magazine release 200 from entering the receiver frame 102 when returning to a rest position.

While embodiments of the present disclosure illustrate that the handgun 100 may receive the magazine release 200 and/or the magazine release 200 may be integrated into the handgun 100, it should be understood that the handgun 100 or components of the handgun 100 may not form part of the claimed invention or design but rather is only a portion of an environment in which the claimed invention or design operates. Therefore, the above description should not be interpreted as a limitation on the scope of the present disclosure but merely an illustration.

Advantages of the present disclosure include a magazine release for a handgun. Advantages of the present disclosure also include a button of the magazine release configured to reduce an amount of force and/or direction of motion necessary to actuate the magazine release. Advantages of the present disclosure also include maintaining or lessening the potential for accidental release of the magazine by reducing the size and/or profile of a magazine release button while retaining intended functionality. Advantages of the present disclosure also include a method of installing and rotatably coupling the components of the magazine release together within the handgun.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

Although a user is described herein as a single figure, those skilled in the art will appreciate that the user may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components.

In some instances, one or more components may be referred to herein as "configured to," "configurable to," "operable/operative to," "adapted/adaptable," "able to," "conformable/conformed to," etc. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B.

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Although particular embodiments of this invention have been illustrated, it is apparent that various modifications and embodiments of the invention may be made by those skilled in the art without departing from the scope and spirit of the foregoing disclosure. It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Accordingly, the scope of the invention should be limited only by the claims appended hereto.

What is claimed:

1. A system, comprising:

a magazine release assembly, comprising:

a first component including at least one interlocking protrusion of an interlocking assembly and a button with a sloped surface; and an additional component including at least one interlocking recess of the interlocking assembly and a catch spring slot, a handgun including a receiver frame, wherein the receiver frame comprises:

a first magazine release opening configured to receive the first component of the magazine release assembly;

an additional magazine release opening configured to receive the additional component of the magazine release assembly so that the additional component is inserted into a magazine cavity defined within the receiver frame; and a catch spring retaining slot configured to hold a catch spring, wherein the at least one interlocking recess is configured to rotatably couple with the at least one interlocking protrusion by swinging the at least one interlocking recess from within the magazine cavity into the receiver frame, wherein the catch spring slot is configured to receive the catch spring following the rotatable coupling of the at least one interlocking recess and the at least one interlocking protrusion.

2. The system in claim 1, wherein the first component is configured to be inserted into the first magazine release opening in a direction substantially parallel to a central axis through the magazine release assembly.

3. The system in claim 1, wherein the additional component is configured to be inserted into the additional magazine release opening in a direction at an angle to a central axis through the magazine release assembly.

4. The system in claim 1, wherein the magazine release assembly is configured to be actuated via a force in a direction perpendicular to a central axis through the sloped surface.

5. The system in claim 4, wherein the sloped surface of the button is a first sloped surface, wherein the button includes an additional sloped surface, wherein the magazine release assembly is configured to be actuated via a force in a direction perpendicular to a central axis through the additional sloped surface, wherein the additional sloped surface is sloped in a different direction than the first sloped surface.

6. The system in claim 1, wherein the button includes a curved surface, wherein the magazine release assembly is configured to be actuated via a force in a direction parallel to a central axis through the curved surface.

7. The system in claim 1, wherein the button includes a contour profile surface configured to map to the receiver frame when the magazine release assembly is in a depressed position.

8. The system in claim 1, wherein the at least one interlocking recess includes a limiting surface configured to prevent the at least one interlocking protrusion from passing through the at least one interlocking recess.

9. The system in claim 1, wherein the interlocking assembly includes a dovetail assembly.

10. The system in claim 9, wherein the at least one interlocking protrusion includes one or more dovetail recesses, wherein the at least one interlocking recess includes one or more dovetail protrusions, wherein the one or more dovetail recesses are configured to receive the one or more dovetail protrusions.

11. The system in claim 1, wherein the additional component comprises:

a pry tool slot, wherein the at least one interlocking recess is configured to uncouple from the at least one interlocking protrusion when a force is applied to the additional component via the pry tool slot.

12. The system in claim 1, wherein the receiver frame includes a frame edge.

13. The system in claim 12, wherein the interlocking assembly is configured to be integrated into the magazine release assembly at a position where the frame edge prevents the first component and the additional component from uncoupling when the magazine release assembly is in a rest position.

14. The system in claim 12, wherein the interlocking assembly is configured to be integrated into the magazine release assembly at a position where the frame edge does not interface with the rotatable coupling of the first component and the additional component when the magazine release assembly is in a depressed position.

15. The system in claim 1, wherein the receiver frame includes a limit cut.

16. The system in claim 15, wherein the additional component includes a limit protrusion, wherein the limit cut is configured to interact with the limit protrusion and prevent the additional component from entering the receiver frame when the catch spring provides a force to actuate the magazine release assembly from a depressed position to a rest position.

17. The system in claim 1, wherein the receiver frame includes an opening configured to receive a magazine.

18. The system in claim 17, wherein the additional component includes a magazine catch configured to interact with a tab molded on the magazine.

19. A magazine release assembly, comprising:

a first component including at least one interlocking protrusion of an interlocking assembly and a button with a sloped surface, wherein the first component is insertable into a first opening within a receiver frame of a handgun; and an additional component including at least one interlocking recess of the interlocking assembly and a catch spring slot, wherein the additional component is insertable into a magazine cavity defined within the receiver frame via an additional opening within the receiver frame of the handgun, wherein the at least one interlocking recess is configured to rotatably couple with the at least one interlocking protrusion by swinging the at least one interlocking recess from within the magazine cavity into the receiver frame, wherein the catch spring slot is configured to receive a catch spring following the rotatable coupling of the at least one interlocking recess and the at least one interlocking protrusion.

20. A method comprising:

inserting a first component of a magazine release assembly into a first opening within a receiver frame of a handgun, wherein the first component includes at least one interlocking protrusion of an interlocking assembly and a button with a sloped surface;

inserting an additional component of the magazine release assembly into a magazine cavity defined within the receiver frame via an additional opening within the receiver frame of the handgun, wherein the additional component includes at least one interlocking recess of the interlocking assembly and a catch spring slot;

rotatably coupling the at least one interlocking recess with the at least one interlocking protrusion within by swinging the at least one interlocking recess from within the magazine cavity into the receiver frame; and coupling a catch spring within the receiver frame of the handgun to the catch spring slot.

* * * * *